US006164929A

United States Patent [19]

Kazuya et al.

[11] Patent Number: 6,164,929

[45] Date of Patent: Dec. 26, 2000

[54] REFRIGERANT COMPRESSOR WITH COOLING MEANS

[75] Inventors: Kimura Kazuya; Okada Masahiko; Kaneshige Yuji, all of Kariya, Japan

[73] Assignee: Kabushiki Kaisha Toyoda Jidoshokki Seisakusho, Kariya, Japan

[21] Appl. No.: 09/197,853

[22] Filed: Nov. 23, 1998

[30] Foreign Application Priority Data

Nov. 27, 1997 [JP] Japan ..... 9-326431

[51] Int. Cl.[7] ..... F04B 17/00

[52] U.S. Cl. ..... 417/362; 417/222.2

[58] Field of Search ..... 417/201, 222.2, 417/223, 362, 373

[56] References Cited

U.S. PATENT DOCUMENTS

| | | | |
|---|---|---|---|
| 5,363,912 | 11/1994 | Wolcott | 166/72 |
| 5,642,798 | 7/1997 | Muirhead et al. | 192/84.961 |
| 5,893,706 | 4/1999 | Kawaguchi et al. | 417/373 |
| 5,899,811 | 5/1999 | Kishibuchi et al. | 464/30 |

FOREIGN PATENT DOCUMENTS

| | | |
|---|---|---|
| 0 736 690 | 10/1996 | European Pat. Off. . |
| 0 740 077 | 10/1996 | European Pat. Off. . |
| 6346883 | 12/1994 | Japan . |
| 6346885 | 12/1994 | Japan . |
| 7035064 | 2/1995 | Japan . |
| 9177675 | 7/1997 | Japan . |
| 9177946 | 7/1997 | Japan . |
| 9228975 | 9/1997 | Japan . |

OTHER PUBLICATIONS

Patent Abstract of Japan No. 09177946.

European Search Report.

*Primary Examiner*—Henry C. Yuen

*Assistant Examiner*—Mahmoud M. Gimie

*Attorney, Agent, or Firm*—Burgess, Ryan & Wayne

[57] ABSTRACT

A refrigerant compressor with a drive power transmission unit accommodating therein a cooling unit capable of promoting heat dissipation from the drive power transmission unit including a rotor element operatively linked to a vehicle engine, a rotary hub-like plate fixed to a drive shaft of the compressor, the rotor element and the rotary hub-like plate being separate members and operatively connected through a transmission controlling member formed by a damper member and a torque limiter. The damper member and the torque limiter are deformable to perform their transmission controlling function. Fins may be formed in a radial arrangement around the axis "L" of the drive shaft on the rotary hub-like plate.

10 Claims, 6 Drawing Sheets

REFRIGERANT COMPRESSOR WITH COOLING MEANS

BACKGROUND OF THE INVENTION

1. Field of the Invention

The present invention relates to a refrigerant compressor with cooling means for use, for example, in an automotive air conditioning system.

2. Description of the Related Art

FIG. 8 illustrates a part, i.e., a drive power transmission unit, of a typical refrigerant compressor according to the prior art. The compressor has a housing 101 accommodating a compression mechanism not shown, therein. A drive shaft 102 is operatively connected to a compression mechanism, and has a part projecting outside from the housing 101 to receive a drive power from an external drive power source. A shaft seal member 103 is mounted in the housing 101 for making a sealing contact with the outer circumference of the drive shaft 102. The drive shaft 102 is connected to a vehicle engine 104, via a solenoid clutch 105 and a pulley belt 106 which form the drive power transmission unit. When the solenoid clutch 105 is energized to provide a mechanical connection between the vehicle engine 104 and the drive shaft 102 during the operation of the vehicle engine 104, the drive shaft 102 is driven for rotation, so that the compression mechanism compresses a refrigerant gas.

The solenoid clutch 105 has a rotating hub-like plate 107 fixedly mounted on the part extending outside the housing 101 of the drive shaft 102, a pulley-like rotor element 108 supported for rotation on an outer wall surface of the housing 101, a core 109 disposed inside the rotor element 108, and an armature 111 supported on the rotating plate 107 by a flat spring 110. The armature 111 is pressed on the rotor 108, against the resilience of the flat spring 110, by a magnetic attraction generated by electro-magnetically energizing the core 109 to transmit a drive power from the rotor 108 to the rotating plate 107 fixed to the drive shaft 102.

FIG. 7 shows a part of a clutchless-type compressor different from the afore-mentioned clutch-accommodating type compressor and provided with a drive power transmission unit having no clutch mechanism between a vehicle engine 104 and a drive shaft 102. The drive power transmission unit of the clutchless type compressor has a pulley element 112 instead of a solenoid clutch 105. The pulley element 112 is combined with a bushing 113 fixed to a front end part of the drive shaft 102 projecting outside a housing 101, and a rotor member 114 around which a belt 106 driven by the vehicle engine 104.

The drive shaft 102 is in sliding contact with a shaft seal 103 similar to the shaft seal 103 of the compressor of FIG. 8. The shaft seal 103 is heated up to a high temperature by friction between the rotating drive shaft 102 and the shaft seal 103 and therefore, a part of the heat generated in the shaft seal 103 is dissipated through the drive shaft 102 at a portion thereof extending outside from the housing 101. In the clutchless type compressor of FIG. 7, the bushing 113 and the rotor 114 combined together, and hence heat is transferred at high heat transfer efficiency from the bushing 113 to the rotor 114. Accordingly, it can be expected that heat transmitted by the drive shaft 102 outside the housing 101 is radiated from the bushing 113 and the rotor 114 at a high efficiency, i.e., the entire pulley 112 exhibits a high heat-radiation effect. Consequently, the lifetime of the shaft seal 103 is extended and the shaft seal 103 can maintain its satisfactory function to seal the clearance around the drive shaft 102 for an extended period of use.

Nevertheless, in the clutch-accommodated type compressor of FIG. 8, the rotating plate 107 and the rotor 108 of the drive power transmission unit are separate members, and the rotating plate 107 and the rotor element 108 are connected by the flat spring 110 and the armature 111. The flat spring 110 consists of a thin plate so that it is elastically deformable and accordingly, forms a passage of a only small sectional area to transmit heat from the rotating plate 107 to the rotor 108. Thus, it is understood that the flat spring 110 is an impediment to heat transmission which reduces the efficiency of heat transmission from the rotating plate 107 to the rotor 108. Consequently, the heat dissipating effect of the rotor 108 having a large surface area is not as much as expected, and the heat radiating effect of the solenoid clutch 105 is rather small.

Further, in some recent clutchless type compressors, not shown, a pulley similar to the pulley element 112 of FIG. 7 is constructed by a combination of a bushing and a rotor which are similar to the elements 113, 114 of FIG. 7. However, the bushing and the rotor element are elastically connected by a damping member or members made of a synthetic rubber. The damping member elastically deforms so as absorb a variation in the load torque which is generated in the compression mechanism of the compressor.

In such a clutchless type compressor, the damping member of the drive power transmission unit is impediment to heat transmission and reduces the efficiency of transmission of heat from the bushing to the rotor element because the thermal resistance of the synthetic rubber is greater than those of metals. Consequently, the heat radiating effect by the rotor element of the drive power transmission cannot be very large, and the heat radiation effect exhibited by the pulley 112 is small, and accordingly, cooling of the compressor is insufficient.

SUMMARY OF THE INVENTION

An object of the present invention is to solve the problems encountered by the prior art.

Another object of the present invention to provide a refrigerant compressor with cooling means capable of enhancing a heat radiating effect for radiating heat generated by the compressor during the compressing operation thereof.

A further object of the present invention is to provide a refrigerant compressor with cooling means for increasing a heat-radiation effect from a drive power transmission unit disposed generally at a front end of the refrigerant compressor.

In accordance with the present invention, there is provided a refrigerant compressor comprising:

a housing unit accommodating a compression mechanism therein; a drive shaft rotatably supported by said housing unit and having an axial inner portion extending through the housing unit and an axial outer portion extending outward from the housing unit, the axial inner portion being operatively connected to the compression mechanism, and the axial outer portion receiving a drive power from an external drive power source; a shaft-seal member provided to be in constant contact with an outer circumference of the drive shaft for sealing the drive shaft with respect to an interior of the housing unit; a rotary drive-power transmission unit having a rotary hub-like plate fixed to a part of the axial outer portion of the drive shaft, a rotor element driven for rotation by the external drive power source, and a deformable member interposed between the rotary hub-like plate and the rotor element to perform a transmission controlling function in response to being deformed; and a cooling means for promoting heat dissipation from the compressor during the rotation of the drive shaft, the cooling means comprising a heat radiating unit formed on the rotary hub-like plate for radiating heat transmitted through the drive shaft.

In this compressor, the drive power of the external drive power source is transmitted through the rotor element, the elastically deformable member and the rotary hub-like plate of the rotary drive power transmission unit to the drive shaft to drive the compression mechanism by rotating the drive shaft. The shaft-seal member in a sliding contact with the drive shaft is rubbed by the drive shaft and heat is generated in the shaft-seal member when the drive shaft is rotating. A part of the heat generated in the shaft-seal element is transferred through the drive shaft to the rotary hublike plate. Then, the heat attempts to flow through the elastically deformable member performing the transmission controlling function to the rotor element. However, the elastically deformable member which performs its predetermined function, i.e., the transmission controlling function by its deformation, such as a damping member or a torque limiter, impedes the flow of the heat to reduce the efficiency of heat transfer from the rotary hub-like plate to the rotor element. Therefore, it is inappropriate to depend so much on the heat radiating effect of the rotor element having a large surface area. However, the heat radiating unit promotes heat radiation from the rotary hub-like plate and hence the heat radiating effect of the rotary drive power transmission unit can be sufficiently high.

The heat radiating unit may comprise fins, preferably formed on a part of the rotary hub-like plate.

The fins increase the surface area of the rotary hub-like plate to enhance the heat radiating effect of the rotary hub-like plate.

Preferably, the fins are formed as a cooling fan capable of promoting heat dissipation from the rotary hub-like plate when the rotating plate rotates. Thus, air currents are produced around the fin to promote heat dissipation from the rotary hub-like plate.

Preferably, the rotary hub-like plate has a thickness increasing from the outer toward the inner circumference thereof.

A part of the rotary hub-like plate near the inner circumference of the rotary hub-like plate around the drive shaft and formed with a large thickness, has a low thermal resistance and hence heat can be transferred from the drive shaft to the rotary hub-like plate efficiently. A part of the rotary hub-like plate near the outer circumference of the rotary hub-like plate is formed in a small thickness to reduce the weight thereof.

Alternatively, the fins are formed integrally with the rotary hub-like plate. Thus, heat can be efficiently transferred from the rotary hub-like plate to the fins.

The fins and the rotary hub-like plate may be separate members.

The fins can be made of a material suitable for radiating heat, and the rotary hub-like plate required to transmit drive power can be made of a material having a high strength.

Preferably, a contact member for enhancing a close contact between the fins and the rotary hub-like plate is interposed therebetween.

The closeness of contact between the rotary hub-like plate and fins can be increased by the contact member without using welding or the like. Consequently, the efficiency of heat conduction from the rotary hub-like plate to the fins can be increased to enhance the heat radiating effect of the rotary hub-like plate.

Preferably, the deformable member is a damper elastically and operatively connecting the rotary hub-like plate and the rotor element of the drive power transmission unit.

The damper deforms elastically to absorb variations of a load torque transmitted from the compression mechanism.

The deformable member is a torque limiter which is deformed or disengaged from the rotary hub-like plate to interrupt transmission of the drive power between the rotor element and the rotary hub-like plate when a load torque of the compression mechanism is excessively high.

When the load torque on the compression mechanism is excessively high, the torque limiter is deformed or disengaged to interrupt the transmission of drive power from the rotor element to the rotary hub-like plate.

The rotary drive power transmission unit may be a solenoid clutch having an armature supported on the rotary hub-like plate by an elastically deformable member, and a core mounted on the rotor element, and the elastically deformable member serving as the member to perform the transmission controlling function.

The core generates a magnetic attraction when magnetized to attract the armature to the rotor element of the drive power transmission unit. Consequently, the elastic member is warped elastically toward the rotor element, the armature is pressed against the rotor element, and the drive power of the external drive source is transmitted through the rotor to the drive shaft. When the core is demagnetized, the armature is separated from the rotor by the resilience of the warped elastic member to intercept the transmission of the driving force from the rotor to the drive shaft.

BRIEF DESCRIPTION OF THE DRAWINGS

The above and other objects, features and advantages of the present invention will be made more apparent from the ensuing description of the preferred embodiments with reference to the accompanying drawings wherein.

DESCRIPTION OF THE PREFERRED EMBODIMENTS

[First Embodiment]

The present invention will be described as applied to a variable-capacity clutchless type compressor according to a first embodiment of the present invention to be employed in an automotive air conditioning system.

Figure 1:
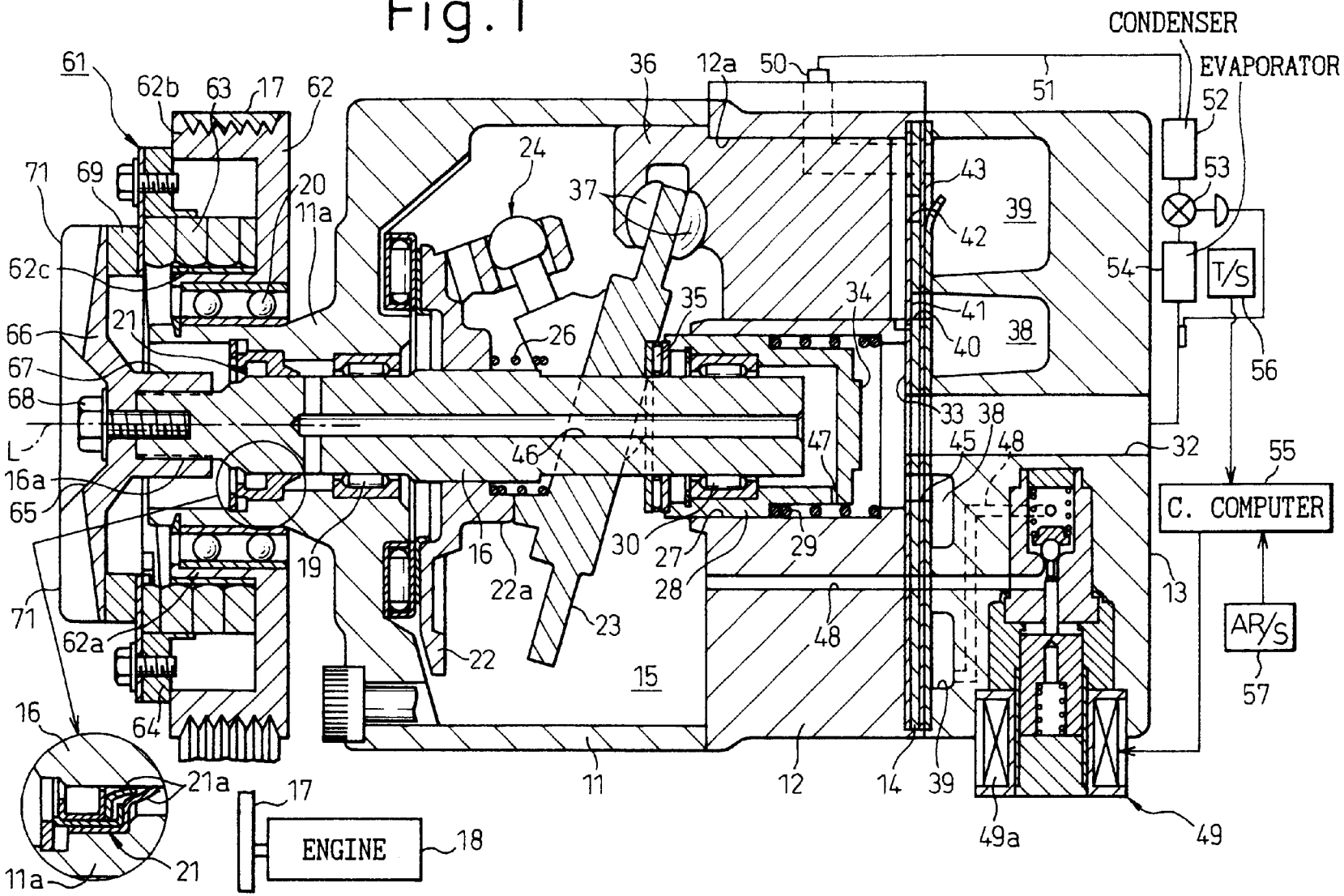
FIG. 1 is a longitudinal sectional-view of a clutchless type variable capacity refrigerant compressor provided with a cooling unit, according to a first embodiment of the present invention.

Referring to FIG. 1, a front housing 11 is fixedly connected to the front end of a cylinder block 12 functioning also as a center housing. A rear housing 13 is fixedly connected to the rear end of the cylinder block 12 with a valve assembly 14 sandwiched between the cylinder block 12 and the rear housing 13. The front housing 11 and the cylinder block 12 define a crank chamber 15. A drive shaft 16 is extended across the crank chamber 15 and is supported for rotation on the front housing 11 and the cylinder block 12. A front end part of the drive shaft 16 is rotatably supported by a radial bearing 19 mounted on the front housing 11 and extends frontward beyond a front wall of the front housing 11.

The front housing 11 has a boss 11*a* formed integrally with the front wall thereof so as to surround the front end part of the drive shaft 16 projecting outside from the housing assembly including the front housing 11, the cylinder block 12, and the rear housing 13. A pulley 61, i.e., a rotating element, is supported for rotation on an angular-contact bearing 20 mounted on the boss 11*a* of the front housing 11 to form an important constituent of a drive power transmission unit of the compressor. The pulley 61 is fixedly mounted on the housing assembly and arranged outside the assembly (the housing elements 11 through 13). The pulley 61 is directly connected to a vehicle engine 18, i.e., an external drive-power source, via a belt 17, and a clutch mechanism, such as a solenoid clutch, is not interposed between the pulley 61 and the vehicle engine 18. The drive shaft 16 is driven for rotation through the belt 17 and the pulley 61 of the drive power transmission unit by the vehicle engine 18 while the vehicle engine 18 is in operation.

A lip-seal element 21, i.e., a shaft sealing element, provided with a sealing lip 21*a* is fitted in the boss 11*a* of the front housing 11. The sealing lip 21*a* of a synthetic rubber or polytetrafluoroethylene is kept in constant contact with an annular region in the outer circumference of the drive shaft 16 to seal a minute clearance around the drive shaft 16.

A rotary support member 22 is fixedly mounted on the drive shaft 16 in the crank chamber 15. A swash plate 23 is supported on the drive shaft 16 so as to be slidable along and to be tiltable relative to the central axis "L" of the drive shaft 16. The rotary support member 22 and the swash plate 23 are interlocked by a hinge unit 24. Therefore, the swash plate 23 can be tilted relative to the central axis "L" of the drive shaft 16 and can be rotated together with the drive shaft 16 by the hinge unit 24. An angle of inclination of the swash plate 23 with respect to a plane perpendicular to the central axis "L" of the drive shaft 16 is reduced when a radially central part of the swash plate 23 moves toward the cylinder block 12. An inclination reducing spring 26 is interposed between the rotary support member 22 and the swash plate 23 to bias the swash plate 23 in an inclination reducing direction. An inclination limiting projection 22*a* projecting from the rear surface of the rotary support member 22 limits a maximum angle of inclination of the swash plate 23.

A through-hole 27 is formed in a radially central part of the cylinder block 12. A cylindrical blocking member 28 is slidably fitted in the through-hole 27. A suction-passage opening spring 29 is interposed between an end surface of the through-hole 27 and the blocking member 28 to bias the blocking member 28 toward the swash plate 23.

A rear end part of the drive shaft 16 is inserted into the blocking member 28 and is rotatably supported by a radial bearing 30 fitted in the bore of the blocking member 28. The radial bearing 30 is able to slide together with the blocking member 28 along the central axis L of the drive shaft 16.

An inlet passage 32 is formed in central parts of the rear housing 13 and the valve assembly 14. The inlet passage 32 is fluidly connected to the through hole 27. A radial positioning surface 33 is formed on the front surface of the valve assembly 14 around an opening formed in the valve assembly 14. A blocking surface 34 is formed in an end of the blocking member 28 so as to be pressed against or separated from the radial positioning surface 33 as the blocking member 28 moves. When the blocking surface 34 is tightly pressed against the radial positioning surface 33, the inlet passage 32 is fluidly disconnected from the through-hole 27.

A thrust bearing 35 is mounted on the drive shaft 16 between the swash plate 23 and the blocking member 28 so as to be slidable on the drive shaft 16. The suction passage opening spring 29 biases the blocking member 28 toward the swash plate 23 so that the thrust bearing 35 is held between the swash plate 23 and the blocking member 28.

As the swash plate 23 is moved toward the blocking member 28, the swash plate 23 pushes the blocking member 28 through the thrust bearing 35, and toward the positioning surface 33, against the resilience of the suction passage opening spring 29 and, eventually, the disconnecting surface 34 of the blocking member 28 is pressed against the positioning surface 33. Further movement of the swash plate 23 toward the blocking member 28 is inhibited upon contact of the disconnecting surface 34 with the positioning surface 33. In this state, the swash plate 23 is inclined at a minimum angle of inclination slightly greater than 0°.

Each cylinder bore 12*a* is formed through the cylinder block 12, and a single-acting piston 36 is fitted in the cylinder bore 12*a*. The piston 36 is retained on a peripheral part of the swash plate 23 by shoes 37. The rotation of the swash plate 23 reciprocates the pistons 36 in the respective cylinder bores 12*a*.

A suction chamber 38 for the refrigerant gas before compression and a discharge chamber 39 for the refrigerant gas after compression are defined in the rear housing 13, and separated from one another. The valve assembly 14 is provided with a plurality of suction ports 40 for the uncompressed refrigerant gas, a plurality of suction valves 41 for closing the respective suction ports 40, a plurality of discharge ports 42 for the compressed refrigerant gas, and a plurality of discharge valves 43 for closing the discharge ports 42 formed therein. Namely, when the swash plate 23 is rotated, the refrigerant gas before compression is sucked from the suction chamber 38 through the respective suction ports 40 and suction valves 41 into the respective cylinder bores 12*a*, and the refrigerant gas sucked into the cylinder bores 12*a* is compressed by the reciprocating pistons 36 to a predetermined pressure, and is discharged through the respective discharge ports 42 and discharge valves 43 into the discharge chamber 39.

The suction chamber 38 fluidly communicates with the through-hole 27 via a port 45 formed in the valve assembly 14. When the disconnecting surface 34 of the blocking member 28 is brought into contact with the positioning surface 33, the port 45 is disconnected from the inlet passage 32. The drive shaft 16 is provided with a passage 46 centrally formed therein to fluidly connect the crank chamber 15 to an internal space provided in the blocking member 28. A pressure relief passage 47 is formed in a part of a cylindrical wall of the blocking member 28. The internal space of the blocking member 28 fluidly communicates with the through-hole 27 of the cylinder block 12 via the pressure relief passage 47.

A supply passageway 48 is provided in the cylinder block 12 and the rear housing 13 to fluidly connect the discharge chamber 39 to the crank chamber 15. A capacity control valve 49 is arranged in a portion of the supply passageway 48 to control the fluid communication between the discharge chamber 39 and the crank chamber 15.

In the compressor thus constructed, the inlet passage 32 through which the refrigerant gas is introduced into the suction chamber 38, and a discharge flange 50 through which the refrigerant gas is discharged from the discharge chamber 39 are connected to an external refrigerating circuit 51. The external refrigerating circuit 51 includes a condenser 52, an expansion valve 53 and an evaporator 54.

A temperature sensor 56 is disposed at a position near the evaporator 54 to constantly measure the temperature of the evaporator 54 and to give temperature information about the evaporator to a control computer 55. The control computer 55 controls energizing and de-energizing of a solenoid 49*a* included in the capacity control valve 49 on the basis of the temperature information given thereto. The control computer 55 gives a command to de-energize the solenoid 49*a* of the capacity control valve 49 when the temperature of the evaporator 54, measured by the temperature sensor 56, is not higher than a set threshold temperature in a state where an air conditioner regulating switch 57 is turned on. Temperatures not higher than the set threshold temperature indicate a condition which may cause frosting of the evaporator 54. When the air conditioner regulating switch 57 is turned off, the control computer 55 de-energizes the solenoid 49*a* of the capacity control valve 49.

When the solenoid 49*a* is de-energized, the supply passageway 48 is opened to provide a fluid connection between the discharge chamber 39 and the crank chamber 15. Therefore, the high-pressure refrigerant gas flows from the discharge chamber 39 through the supply passageway 48 into the crank chamber 15, and accordingly, a pressure prevailing in the crank chamber 15 is increased. Thus, the inclination of the swash plate 23 from a plane perpendicular to the central axis "L" of the drive shaft 16 is decreased to the minimum angle of inclination due to the increased pressure within the crank chamber 15.

The sectional area of the suction passage 32 is reduced to zero upon the contact of the disconnecting surface 34 of the blocking member 28 with the positioning surface 33 to inhibit the flow of the refrigerant gas from the external refrigeration circuit 51 into the suction chamber 38.

Since the minimum angle of inclination of the swash plate 23 is not equal to 0°, the refrigerant gas is discharged from the cylinder bores 12*a* into the discharge chamber 39 while the swash plate 23 is inclined at the minimum angle of inclination. The refrigerant gas is sucked from the suction chamber 38 into the cylinder bores 12*a* and is discharged into the discharge chamber 39. With the swash plate 23 at the minimum angle of inclination, a circulation passage passing the discharge chamber 39, the supply passageway 48, the crank chamber 15, the passage 46, the pressure relief passage 47, the suction chamber 38 and the cylinder bore 12*a* is formed in the compressor. Lubricating oil flowing together with the refrigerant gas flows through the above-mentioned circulation passage to lubricate the interior of the compressor. The pressures prevailing in the discharge chamber 39, the crank chamber 15 and the suction chamber 38 are different from one another, and therefore, the swash plate 23 is held stably at the minimum angle of inclination by the effects of the pressure differences and the sectional area of the pressure relief passage 47.

When the solenoid 49*a* of the capacity control valve 49 is energized to close the supply passageway 48, the gas flows from the crank chamber 15 through the passage 46 and the pressure relief passage 47. Therefore, the pressure in the crank chamber 15 is reduced. As a result, the angle of inclination of the swash plate 23 increases from the minimum angle to the maximum angle of inclination.

A description of a cooling unit for cooling the shaft seal of the refrigerant compressor of the first embodiment will be provided below.

The construction and arrangement of the pulley 61 of the drive power transmission unit arranged at the front end of the refrigerant compressor will be first described. A rotor element 62 has a cylindrical boss 62*a* in its inner periphery, and a cylindrical pulley rim 62*b* in its outer periphery. The cylindrical boss 62*a* of the rotor element 62 is fixedly fitted on the outer ring of the angular-contact bearing 20. The outer circumference of the boss 62*a* is coated with a synthetic resin layer 62*c*. The rotor element 62 is coaxial with the drive shaft 16 and is connected to the vehicle engine 18 via the belt 17 which is wound around the pulley rim 62*b*.

A torque limiter 63 comprises a coiled torsion spring fastened to the outer circumference of the boss 62*a* of the rotor element 62 in a predetermined interference fit. A ring-like linking member 64 is mounted around the outer circumference of a front end part of the torque limiter 63 so as to be in frictional contact with the torque limiter 63 in a direction of rotation of the rotor element 62.

A rotating plate 65 made of a ferrous or steel material has an annular part 66 and a boss 67 formed integrally with the annular part 66 and projecting rearward from a central part of the rear surface of the annular part 66. A central part of the annular part 66 and the boss 67 of the rotating plate 65 are thick, and the annular part 66 has thickness reducing toward the outer circumference thereof. The boss 67 of the rotating plate 65 is fitted on a reduced part 16*a* of the front end part of the drive shaft 16 and is mated with the reduced part 16*a* by, for example, splines. A bolt 68 is passed through a center hole formed in the annular part 66 and is threadedly engaged in a threaded hole formed in the front end part of the drive shaft 16 to fasten the rotating plate 65 to the drive shaft 16 and to prevent the rotating plate 65 from coming off the drive shaft 16. An annular damper member 69 made of a synthetic rubber material is arranged to be sandwiched between a peripheral part of the rear surface of the annular part 66 of the rotating plate 65 and the linking ring 64 to elastically and operatively link the linking ring 64 and the rotating plate 65. The damper member 69 is capable of elastically deforming in the rotating direction of the drive shaft 16 to absorb variations in the load torque (resistance against driving action) of the compression mechanism (rotating plate 65). The torque limiter 63 and the damper member 69 are individual members which exhibit a specified function due to an elastic deformation thereof, respectively. Thus, the torque limiter 63 and the damper member 69 may be referred to as deformation-reactive function members.

While the compressor is in the normal operation, a load torque acting on the compression mechanism of the compressor is transmitted through the drive shaft 16, the rotating plate 65, the damper member 69, the ring-like linking member 64 and the torque limiter 63 to the rotor element 62. At this stage, a load is applied to the torque limiter 63 in a direction to cause an increase in the inside diameter of the torque limiter 63 via the linking member 64. However, the load torque acting during the normal operation of the compressor is lower than a limit torque determined by the torque limiter 63. Therefore, an increase in the inside diameter of the torque limiter 63 is very small so long as the compressor is in the normal operation. Accordingly, a desired frictional force acts between the contact surfaces of the torque limiter 63 and the boss 62*a* of the rotor element 62 to transmit a drive power from the pulley unit 61 to the drive shaft 16 via the boss 62*a* and the torque limiter 63. Namely, an interruption of the transmission of the drive power from the engine 18 to the refrigerant compressor does not occur at the frictional contacting portion of the torque limiter 63 and the boss 62*a* of the rotor element 62.

When the load torque acting on the compression mechanism exceeds the limit torque determined by the torque limiter 63, and if the excessive load torque is transmitted to the vehicle engine 18, the vehicle engine 18 may stall or the belt 17 will be damaged. The load torque acting through the ring-like linking member 64 on the torque limiter 63 in the direction to increase the inside diameter of the torque limiter 63 increases when an actual load torque acting on the torque limiter 63 increases beyond the limit torque determined by the torque limiter 63 and, therefore, the torque limiter 63 is elastically deformed and the inside diameter thereof increases significantly, the frictional force acting between the torque limiter 63 and the boss 62*a* decreases and, eventually, the torque limiter 63 slips relative to the boss 62*a*. Thus, the transmission of the excessive load torque to the vehicle engine 18 is prevented so that stalling of the vehicle engine 19 can be avoided.

If the duration of the excessive load torque of the compression mechanism is short and the load torque decreases below the limit torque for the torque limiter 63, the torque limiter 63 reduces its inside diameter by its own resilience and fastens tight to the boss 62*a*. Thus, the frictional force acting between the torque limiter 63 and the boss 62*a* of the rotor element 62 is increased to the predetermined frictional force. Consequently, the torque of the rotor element 62 can be transmitted to the drive shaft 16 to resume the normal operation of the compression mechanism.

If the duration of the excessive load torque of the compression mechanism is long, the boss 62*a* is heated at a high temperature by heat generated by friction between the boss 62*a* and the torque limiter 63 and the synthetic resin layer 62*c* coating the inner circumference of the boss 62*a* is melted by the heat, so that the interference between the torque limiter 63 and the boss 62*a* is reduced substantially to zero and the rotor element 62 rotates substantially freely relative to the torque limiter 63. Thus, the application of an excessive load on the vehicle engine 18 by the broken compressor can be avoided.

Figure 2A:
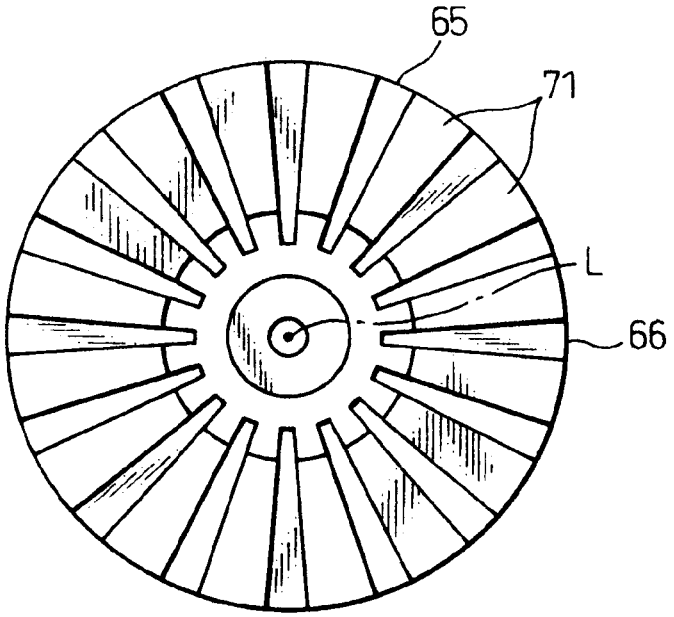
FIG. 2A is a front view of a rotating hub-like plate accommodated in a drive power transmission unit and capable of forming a part of the cooling unit.
Figure 2B:
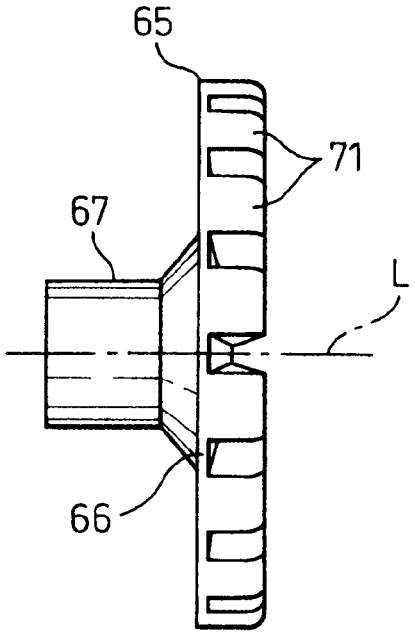
FIG. 2B is a side view of the hub-like plate of FIG. 2A.

As shown in FIGS. 1, 2A and 2B, the rotary hub-like plate 65 of the compressor in the first embodiment is provided with a plurality of fins 71, i.e., heat radiating means. The plurality of fins 71 are radially arranged around the center axis "L" on the front surface of the annular part 66 except for an area in which a through-hole permitting the bolt 68 to pass therethrough is formed.

The plurality of fins 71 may be formed by cutting a plurality of radial grooves on the end face of a workpiece for the production of the annular part 66 around the axis "L". Thus, the fins 71 are formed integrally with the rotary hub-like plate 65. When thus forming the fins 71, the bottom surfaces of the grooves are inclined to the axis "L" to vary the thickness of the annular part 66 from the inner toward the outer circumference of the annular part 66.

A large amount of heat is generated by the frictional sliding contact between the sealing lip 21*a* of the lip-seal element 21 and the drive shaft 16, and the sealing lip 21*a* is heated to a high temperature. Part of the heat is transferred through the drive shaft 16 and its reduced part 16*a* to the boss 67 of the rotary hub-like plate 65. Then, the heat tends to flow from the boss 67 through the annular part 66 of the hub-like plate 65, the damper member 69, the ring-like linking member 64 and the torque limiter 63 to the rotor 62. Since the torque limiter 63 and the damper member 69 having low heat transfer characteristics (particularly the damper member 69 in direct contact with the rotating plate 65 and made of a synthetic rubber providing high thermal resistance) impede heat transfer from the rotating plate 65 to the rotor 62, the heat is transferred from the rotary hub-like plate 65 to the rotor element 62 at a low heat transfer efficiency. Therefore, it is inappropriate to depend on the heat radiating effect of the rotor element 62 having a large surface area.

However, the rotary hub-like plate 65 is provided with the fins 71, and the fins 71 contribute to an appreciable increase in the surface area of the hub-like plate 65. The fins 71 also function as fan blades when the rotating plate 65 rotates. Namely, in response to rotation of the fins 71, air around the central part of the front surface of the annular part 66 is forced to flow radially outward through the spaces between the adjacent fins 71, by centrifugal force, in air currents. The air currents promote the heat radiating performance of the fins 71. Thus the heat can be radiated effectively by the heat radiating effect of the rotary hub-like plate 65 without depending on heat radiation by the rotor element 62 to effectively cool the drive shaft 16 and the sealing lip 21*a* of the lip-seal element 21.

The compressor in the first embodiment can have various advantageous effects as set forth below.

(1) The heat radiating effect of the pulley unit 61 is sufficiently increased without counting on heat radiation by the rotor 62. Accordingly, the life of the lip-seal element 21 is extended so that the lip-seal element 21 is able to maintain its ability to properly seal the clearance around the drive shaft 16 for an extended period of operation. Although only the cooling effect of the cooling unit on cooling the lip-seal element 21 is described throughout the present specification, the same cooling effect can be effective also for cooling other parts, such as the radial bearing 19 in rolling contact with the drive shaft 16.

(2) The fins 71 can be formed easily and can effectively increase the surface area of the rotary hub-like plate 65 as compared with the known surface roughing treatment which can be formed by roughening the surface of the rotary hub-like plate 65 by a shot peening method.

(3) The fins 71 are formed integrally with the rotary hub-like plate 65 and hence heat can efficiently be transferred from the rotary hub-like plate 65 to the fins 71. As a result, the heat radiating effect of the rotary hub-like plate 65 can be increased to result in achievement of further efficient cooling of the lip-seal element 21.

(4) The plurality of fins 71 arranged radially around the axis "L" produce air currents along the fins 71 when the rotary hub-like plate 65 is rotated. The air currents increase the heat radiating effect of the fins 71 so as to achieve effective cooling of the lip-seal element 21.

(5) An inner peripheral part of the rotary hub-like plate 65 around the drive shaft 16 is formed in a large thickness to that the inner peripheral part provides a low thermal resistance. Therefore, heat is efficiently transferred from the drive shaft 16 to the rotary hub-like plate 65 and the effect of the hub-like plate 65 on cooling the drive shaft 16 is further increased. An outer peripheral part of the rotary hub-like plate 65 is formed in a small thickness to form the hub-like plate 65 in a lightweight construction.

(6) The drive shaft 16 of the clutchless type compressor is driven continuously for rotation while the vehicle engine 18 is in operation and the torque limiter 63 is not functioning. Therefore, the lip-seal element 21 is in continuous sliding contact with the drive shaft 16 while the vehicle engine 18 is in operation, and the lip-seal element 21 employed in the clutchless type compressor must be exposed to a thermally difficult condition compared with that to which a lip-seal element employed in a clutch-accommodated type compressor is exposed. Even if the lip-seal element 21 employed in the clutchless type compressor with cooling unit according to the present invention is replaced with a conventional type lip-seal element having no heat-resisting measures, the sealing effect of the lip-seal element can be maintained for an extended period of use due to the cooling effect provided by the cooling unit of the present invention. The use of the conventional type lip-seal element can surely reduce the manufacturing cost of the clutchless type refrigerant compressor.

(Second Embodiment)

Figure 3:
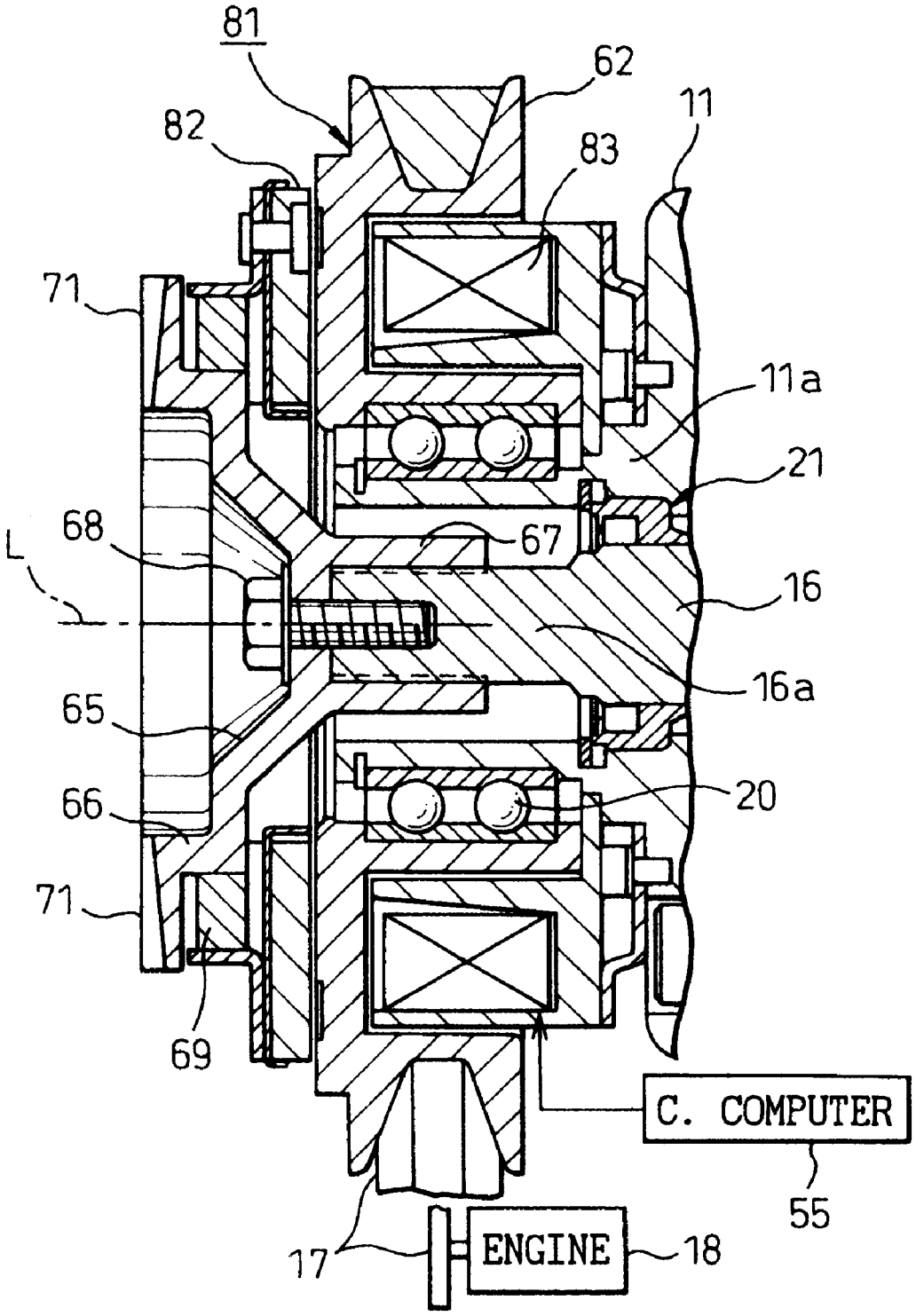
FIG. 3 is a longitudinal sectional-view of a solenoid clutch and its associated parts forming a drive power transmission unit of a refrigerant compressor provided with a cooling unit according to a second embodiment of the present invention.
Figure 4A:
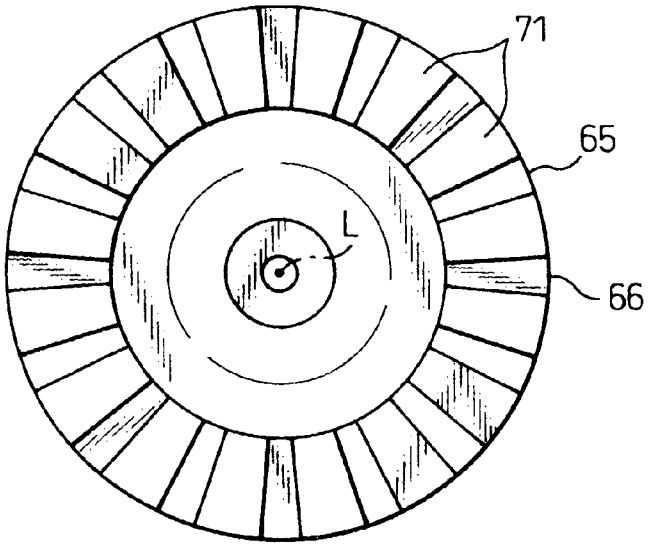
FIGS. 4A and 4B are a front view and a sectional view of a rotating hub-like plate accommodated in the compressor of FIG. 3, and capable of functioning as a cooling unit of the compressor.
Figure 4B:
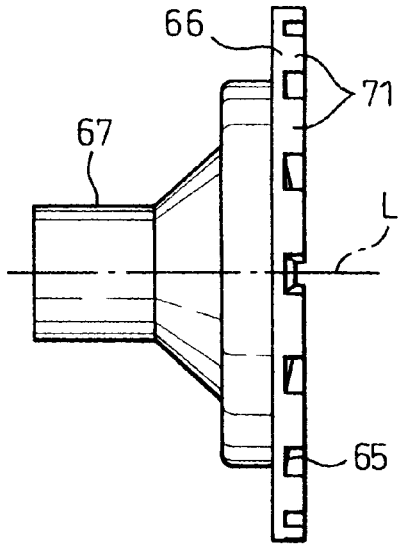

A clutch-accommodated type compressor according to a second embodiment of the present invention will be described with reference to FIGS. 3, 4A and 4B, in which parts and elements like or corresponding to those of the first embodiment are designated by the same reference numerals and accordingly, the description thereof will be omitted.

The compressor of the second embodiment is provided with a solenoid clutch 81 instead of the pulley 61 of the first embodiment. The solenoid clutch 81 is interposed between a vehicle engine 18 and a drive shaft 16, and has an armature 82 supported via a damper member 69, i.e., an elastic member, on a rotary hub-like plate 65, and a core 83 fixed to the outer surface of a front housing 11 so as to be positioned in a rotor element 62. The magnetizing and demagnetizing of the core 83 is controlled by a control computer 55.

The core 83 generates magnetic attraction when magnetized while the vehicle engine 18 is in operation, and therefore, the armature 82 is attracted to the rotor element 62. Thus, the damper member 69 is compressed elastically, the armature 82 is pressed against the rotor element 62, and the drive power of the vehicle engine 18 is transmitted to the drive shaft 16. Thus, a compressing mechanism (not shown in FIG. 3) housed in the housing 11 compresses a refrigerant gas. A variation in a load torque acting on the compressor (rotating plate 65) is absorbed by the circumferential, elastic deformation of the damper member 69 in the rotating direction of the drive shaft 16.

When the magnetized core 83 is demagnetized, the armature 82 is separated from the rotor element 62 by the resilience of the deformed damper member 69 to intercept the transmission of the drive power from the rotor element 62 to the drive shaft 16.

A plurality of fins 71 are formed in a radial arrangement around an axis "L" in an outer peripheral region on the front surface of an annular part 66 of the rotary hub-like plate 65 to provide the same effects as the afore-mentioned advantageous effects (1) to (5) of the first embodiment.

(Third Embodiment)

Figure 5:
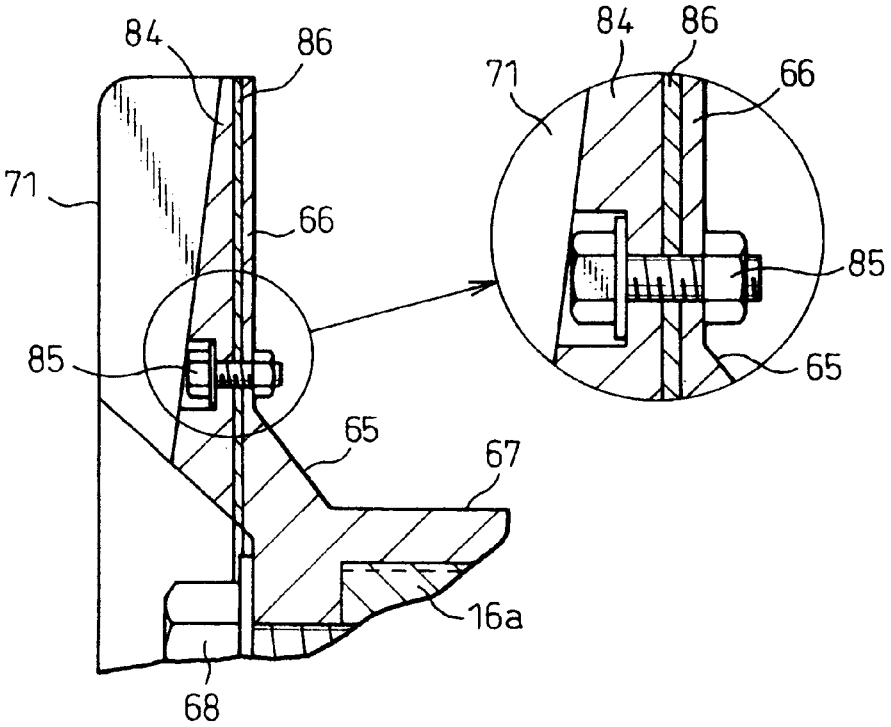
FIG. 5 is an enlarged sectional-view of a part of a rotating hub-like plate accommodated in a refrigerant compressor with a cooling unit according to a third embodiment of the present invention.

A compressor according to a third embodiment of the present invention will be described with reference to FIG. 5, in which parts like or corresponding to those of the first embodiment are designated by the same reference numerals, and accordingly, the description thereof will be omitted.

In the compressor of the third embodiment, fins 71 and a rotary hub-like plate 65 are separate members. The fins 71 are formed by cutting radial grooves in the front surface of an annular plate 84 of aluminum or an aluminum alloy. The annular plate 84 provided with the fins 71 is fastened to the front surface of an annular part 66 of the rotary hub-like plate 65 with bolts 85.

The annular plate 84 integrally provided with the fins 71 can be considered a part of the annular part 66 of the rotating plate 65 because the annular plate 84 serves somewhat in transmitting power from a drive shaft 16 to a rotor element 62. When the annular plate 84 is considered a part of the annular part 66, the radial grooves are inclined to the axis "L" of the drive shaft 16 so that the thickness of a part of the annular plate 84 nearer to the inner circumference is greater than that of a part of the same nearer to the outer circumference. Accordingly, it may be considered that the thickness of a part of the rotary hub-like plate 65 nearer to the inner circumference is greater than that of a part of the same nearer to the outer circumference.

A sheet 86 of silicone rubber, i.e., a contact member for enhancing the close contact between the annular plate 84 and the rotary hub-like plate 65, is sandwiched between the annular plate 84 and the hub-like plate 65.

The third embodiment has the same advantageous effects as the effects (1), (2) and (4) to (6) of the first embodiment. Since the rotary hub-like plate 65 and the annular plate 84 provided with the fins 71 are separate members, the annular plate 84 can be made of an aluminum material which is suitable for heat radiation and for forming a lightweight member, and the rotary hub-like plate 65 which must be capable of transmitting a drive power can be formed of a strong ferrous material.

When the fins 71 and the rotary hub-like plate 65 are separate members, the efficiency of heat transfer from the hub-like plate 65 to the fins 71 is liable to be reduced due to incomplete contact between the rotary hub-like plate 65 and the fins 71. The sheet 86 enhances the closeness of contact between the rotary hub-like plate 65 and the annular plate 84 provided with the fins 71 to secure a high efficiency of heat transfer from the rotary hub-like plate 65 to the annular plate 84 provided with the fins 71. Therefore, forming the annular plate 84 provided with the fins 71, and the rotary hub-like plate 65 in separate members is not disadvantageous in respect of heat transfer efficiency.

Further modifications may be made without departing from the scope of the present invention.

Figure 6:
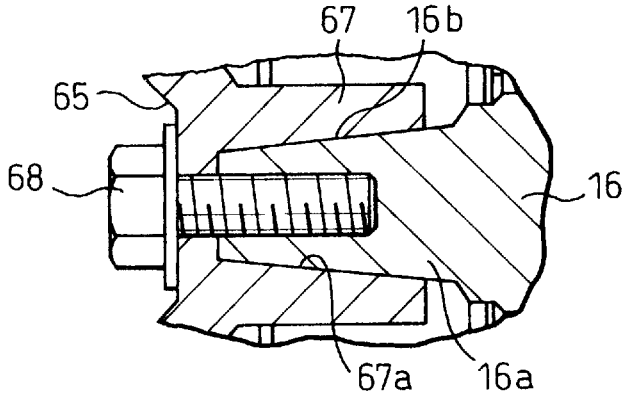
FIG. 6 is an enlarged sectional-view of the boss of a rotating plate and a reduced part of a drive shaft in a modification.
Figure 7:
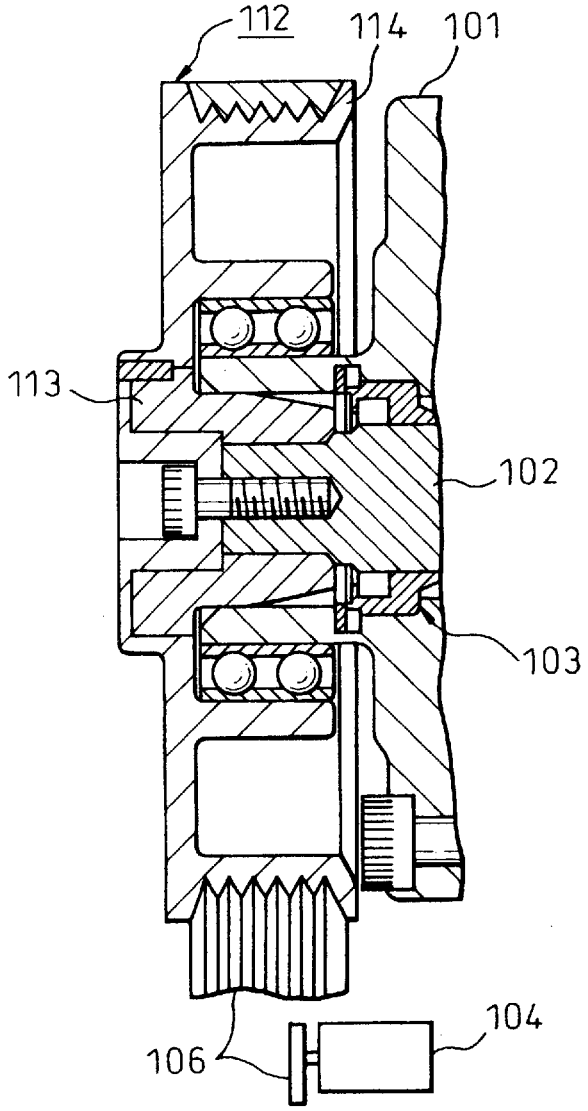
Fig. 7 (PRIOR ART)
FIG. 7 is a sectional-view of a pulley and its associated parts forming a drive power transmission unit of a refrigerant compressor according to one of the prior arts; and, FIG. 8 is a sectional-view of a solenoid clutch forming a drive power transmission unit accommodated in a refrigerant compressor according to another of the prior arts.
Figure 8:
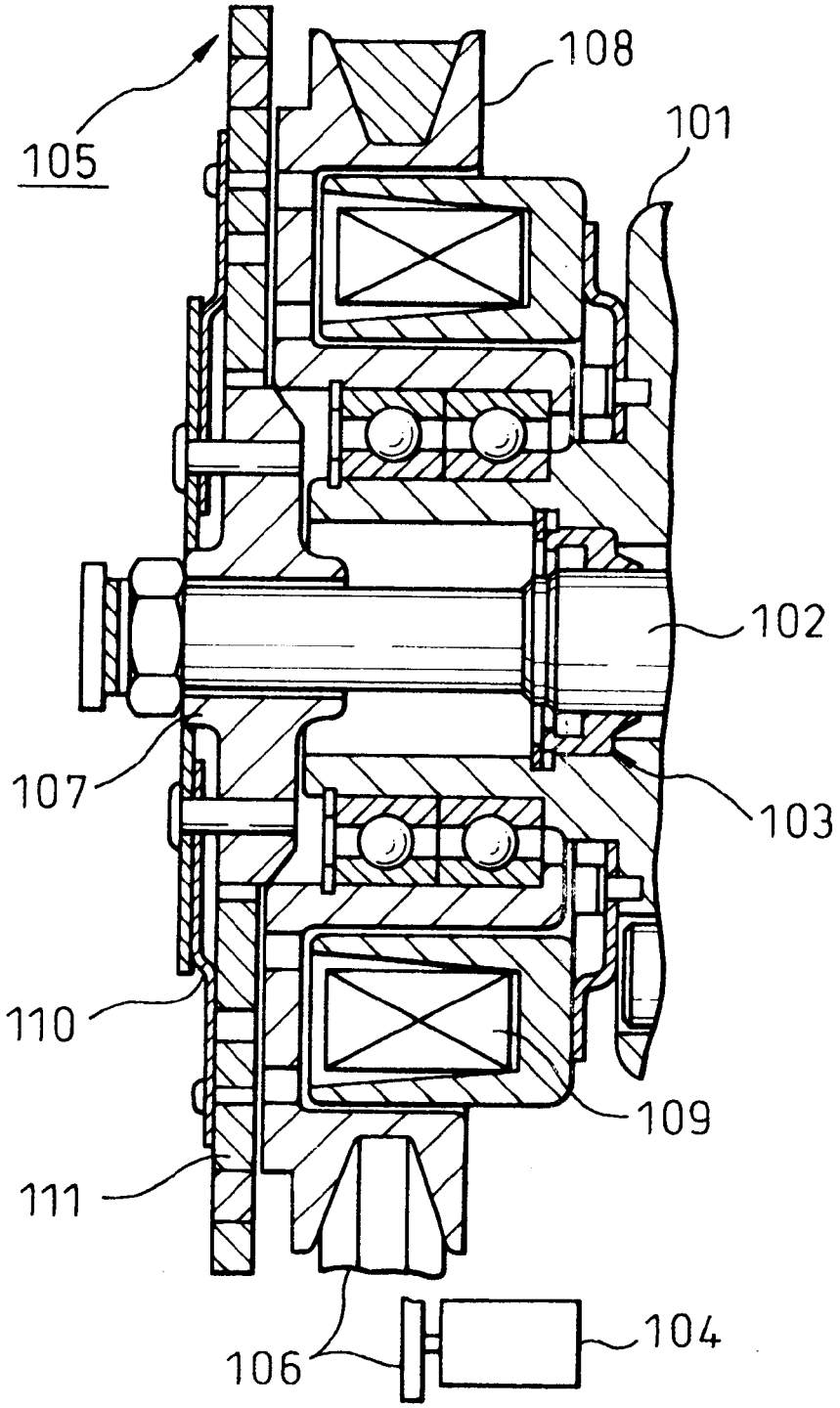
Fig. 8 (PRIOR ART)

As shown in FIG. 6, the outer circumference 16*b* of the reduced part 16*a* of the drive shaft 16 may be tapered toward the front, and the inner circumference 67*a* of the boss 67 of the rotary hub-like plate 65 may be formed in a tapered circumference corresponding to the tapered outer circumference 16*b* of the reduced part 16*a*. The reduced part 16*a* having the tapered circumference 16*b* may be forced into the tapered bore 67*a* of the boss 67 to fasten the rotary hub-like plate 65 to the drive shaft 16. The tapered outer circumference 16*b* of the reduced part 16*a* comes into close contact with the tapered inner circumference 67*a* of the boss 67 and heat can be transferred from the drive shaft 16 to the rotary hub-like plate 65 at a high efficiency and hence the sealing lip 21*a* of the lip-seal element 21 can effectively cooled.

In the third embodiment, the bolts 85 and the sheet 86 may be omitted and the annular plate 84 provided with the fins 71 and the rotary hub-like plate 65 may be welded together by friction welding or the like. The annular plate 84 provided with the fins 71 and the rotary hub-like plate 65 can be joined together by welding as if the annular plate 84 provided with the fins 71 and the rotary hub-like plate 65 are formed in an integral member, and heat can be transferred at a high efficiency from the rotary hub-like plate 65 to the annular plate 84. The omission of the bolts 85 and the sheet 86 reduces the number of the component parts of the compressor. Friction welding rotates the annular plate 84 and the rotary hub-like plate 65 relative to each other to rub the respective mating surfaces of the annular plate 84 and the rotary hub-like plate 65 under high pressure, and stops rotating the annular plate 84 and the rotary hub-like plate 65 after the annular plate 84 and the rotary hub-like plate 65 have been heated to a high temperature by friction heat.

In the foregoing embodiments, the rotary hub-like plate 65 may be provided with plurality of projections on its surface or with a rough surface formed by shot peening or the like instead of the fins 71 to increase the surface area thereof.

In modifications of the first and the third embodiment, the pulley 61 may be provided only with the damper member 69.

In modifications of the first and the third embodiment, the pulley 61 may be provided only with the torque limiter 63. In such modifications, the torque limiter 63, i.e., a coil spring, in direct contact with the rotary hub-like plate 65 and in substantially line contact with the boss 62*a* is a principal impediment to heat transfer from the rotary hub-like plate 65 to the rotor element 62.

The damper member 69 may be omitted from the second embodiment.

The sheet 86 of the third embodiment may be made of a soft metal or a synthetic resin.

The cooling means may be applied to other piston compressors, such as wobble-plate compressors, wave-cam type compressors and double-acting compressors. The cooling means is applicable not only to piston type compressors but also to rotary compressors, such as scroll type compressors and vane type compressors.

It should be understood that many and various changes and modifications will occur to a person skilled in the art without departing from the scope and spirit of the present invention as claimed in the accompanying claims.

What we claim:

1. A refrigerant compressor comprising:

a housing means accommodating a compression mechanism therein;

a drive shaft rotatably supported by said housing means and having an axial inner portion extending through said housing means and an axial outer portion extending outward from said housing means, said axial inner portion being operatively connected to said compression mechanism, and said axial outer portion receiving a drive power from an external drive power source;

a shaft-seal element provided to be in constant contact with an outer circumference of said drive shaft for sealing said drive shaft with respect to an interior of said housing means;

a rotary drive-power transmission means having a rotary hub-like plate fixed to a part of said axial outer portion of said drive shaft, a rotor element driven for rotation by said external drive power source, and a deformable member interposed between said rotary hub-like plate and said rotor element to perform a transmission controlling function to said rotor element in response to being deformed; and a cooling means for promoting heat dissipation from a drive power transmission unit disposed at a front end of said compressor during the rotation of said drive shaft, said cooling means comprising a heat radiating means formed on said rotary hub-like plate for radiating heat transmitted through said drive shaft.

2. The refrigerant compressor according to claim 1, wherein said heat radiating means comprises fins formed on a part of said rotary hub-like plate.

3. The refrigerant compressor according to claim 2, wherein said fins are formed to function as a cooling fan for promoting heat dissipation from said rotary hub-like plate in response to a rotation of said rotary hub-like plate.

4. The refrigerant compressor according to claim 2, wherein said fins are formed integrally with said rotary hub-like plate.

5. The refrigerant compressor according to claim 2, wherein said fins and said rotary hub-like plate are formed as separate members.

6. The refrigerant compressor according to claim 5, wherein a contacting member for enhancing tight contact between said fin and said rotary hub-like plate is interposed between said fin and said rotary hub-like plate.

7. The refrigerant compressor according to claim 1, wherein said rotary hub-like plate is formed to have a thickness increasing from the outer toward the inner circumference thereof.

8. The refrigerant compressor according to claim 1, wherein said deformable member comprises a damper elastically and operatively connecting said rotary hub-like plate and said rotor element of said rotary drive-power transmission means.

9. The refrigerant compressor according to claim 1, wherein said deformable member comprises a torque limiter which is deformed or disengaged to interrupt transmission of a load torque between said rotary hub-like plate and said rotor element when the load torque generated by said compression mechanism is excessively high.

10. The refrigerant compressor according to claim 1, wherein said rotary drive power transmission means comprises a solenoid clutch having an armature supported on said rotary hub-like plate via an elastic member, and a core member mounted on said rotor element, said elastic member forming said elastically deformable member to perform said transmission controlling function.

* * * * *